US008544408B2

(12) United States Patent
Ewers

(10) Patent No.: US 8,544,408 B2
(45) Date of Patent: Oct. 1, 2013

(54) SYSTEM FOR APPLYING METAL PARTICULATE WITH HOT PRESSURIZED AIR USING A VENTURI CHAMBER AND A HELICAL CHANNEL

(76) Inventor: Kevin Wayne Ewers, Corpus Christi, TX (US)

( * ) Notice: Subject to any disclaimer, the term of this patent is extended or adjusted under 35 U.S.C. 154(b) by 257 days.

(21) Appl. No.: 13/069,895

(22) Filed: Mar. 23, 2011

(65) Prior Publication Data

US 2012/0240852 A1 Sep. 27, 2012

(51) Int. Cl.

| | |
|---|---|
| ***B05B 7/00*** | (2006.01) |
| ***B05C 11/00*** | (2006.01) |
| *B05D 3/04* | (2006.01) |
| *B05D 3/02* | (2006.01) |

(52) U.S. Cl.

USPC ..... 118/308; 118/669; 118/691; 118/310; 427/312; 427/383.1

(58) Field of Classification Search

USPC ..... 118/50, 326, 612, 712, 713, 310, 118/308; 427/181, 446, 212, 383.1, 422, 427/474, 191; 451/40, 90, 91; 366/165.2; 51/436; 239/8, 407

See application file for complete search history.

(56) References Cited

U.S. PATENT DOCUMENTS

| | | | | |
|---|---|---|---|---|
| 1,165,338 | A | 12/1915 | Moench | |
| 2,821,346 | A * | 1/1958 | Fisher | 241/39 |
| 3,400,010 | A | 9/1964 | Keating | |
| 3,391,016 | A * | 7/1968 | Mccrary, Jr. et al. | 427/249.15 |
| 3,852,918 | A * | 12/1974 | Black | 451/99 |
| 3,954,512 | A | 5/1976 | Kanter | |
| 3,959,030 | A | 5/1976 | Satake et al. | |
| 4,036,670 | A | 7/1977 | De Walt | |
| 4,202,709 | A | 5/1980 | Shibamori et al. | |
| 4,290,555 | A * | 9/1981 | Suwa et al. | 239/8 |
| 4,546,051 | A | 10/1985 | Uchida et al. | |
| 4,655,852 | A | 4/1987 | Rallis | |
| 4,709,515 | A * | 12/1987 | Copeland et al. | 451/99 |
| 4,934,595 | A * | 6/1990 | Reimer | 239/8 |
| 5,099,619 | A * | 3/1992 | Rose | 451/99 |
| 5,505,566 | A * | 4/1996 | Gruber | 406/12 |
| 5,547,716 | A * | 8/1996 | Thaler | 427/577 |
| 5,605,497 | A * | 2/1997 | Pickard | 451/90 |
| 5,837,316 | A * | 11/1998 | Fuchita | 427/191 |
| 5,932,293 | A * | 8/1999 | Belashchenko et al. | 427/446 |
| 5,958,348 | A * | 9/1999 | Bi et al. | 422/186.04 |
| 5,960,835 | A | 10/1999 | Izaki et al. | |
| 6,280,802 | B1 * | 8/2001 | Akedo et al. | 427/561 |
| 6,531,187 | B2 * | 3/2003 | Akedo | 427/475 |

(Continued)

*Primary Examiner* — Dah-Wei Yuan
*Assistant Examiner* — Karl Kurple
(74) *Attorney, Agent, or Firm* — Buskop Law Group, PC; Wendy Buskop

(57) ABSTRACT

A system for applying a metal particulate onto an object is disclosed herein. The system can include sources for a metal particulate and a hot pressurized air in communication with a spraying device having a nozzle assembly configured to: receive, mix, and expel the metal particulate and the hot pressurized air. The hot pressurized air can form a venturi effect within the nozzle assembly to draw in the metal particulate. The nozzle assembly can include a nozzle cap with a tapered nozzle having a helical channel, and an outer tip connected to the nozzle cap having a venturi effect chamber, a mixing conduit, and rifling. The helical channel can form a vortex flow of the metal particulate, and the mixing conduit can form a vortex flow of the air metal mixture. A nozzle orifice can expel the air metal mixture to onto the object to form a coating thereon.

18 Claims, 6 Drawing Sheets

(56) References Cited

U.S. PATENT DOCUMENTS

| | | | | |
|---|---|---|---|---|
| 6,623,338 | B2 * | 9/2003 | Pettit et al. | 451/41 |
| 6,913,841 | B2 | 7/2005 | Upchurch | |
| 6,919,054 | B2 * | 7/2005 | Gardner et al. | 422/186 |
| 7,168,481 | B2 * | 1/2007 | Ishiyama et al. | 165/165 |
| 7,670,406 | B2 * | 3/2010 | Belashchenko | 75/252 |
| 8,137,765 | B2 * | 3/2012 | Upchurch | 427/591 |
| 8,282,019 | B2 * | 10/2012 | Karimi Esfahani et al. | 239/8 |
| 2004/0253475 | A1 | 12/2004 | Upchurch | |
| 2005/0282031 | A1 | 12/2005 | Upchurch | |
| 2006/0025048 | A1 * | 2/2006 | Billig | 451/5 |
| 2006/0081174 | A1 * | 4/2006 | Baran | 118/50 |
| 2006/0120214 | A1 * | 6/2006 | Raftis | 366/165.2 |
| 2007/0074656 | A1 * | 4/2007 | Zhao et al. | 118/308 |
| 2007/0289508 | A1 * | 12/2007 | Okada et al. | 110/236 |
| 2007/0295833 | A1 * | 12/2007 | Oda et al. | 239/128 |
| 2009/0056620 | A1 * | 3/2009 | Oda et al. | 118/300 |
| 2009/0214888 | A1 | 8/2009 | Upchurch | |
| 2009/0288601 | A1 * | 11/2009 | Bi et al. | 118/722 |
| 2010/0108776 | A1 * | 5/2010 | Esfahani et al. | 239/8 |
| 2010/0193600 | A1 * | 8/2010 | Di Loreto | 239/8 |
| 2010/0304045 | A1 * | 12/2010 | Bisges | 427/569 |
| 2012/0058264 | A1 * | 3/2012 | Filou et al. | 427/181 |
| 2013/0004673 | A1 * | 1/2013 | Ikeda | 427/421.1 |

* cited by examiner

SYSTEM FOR APPLYING METAL PARTICULATE WITH HOT PRESSURIZED AIR USING A VENTURI CHAMBER AND A HELICAL CHANNEL

FIELD

The present embodiments generally relate to a system for spraying metal particulate to form a coating, layer, and/or deposit on a surface, substrate, and/or object.

BACKGROUND

A need exists for a system for spraying metal particulates onto objects to form coatings and the like thereon.

A need exists for a system for forming metal particulate coatings that are at least partially bonded to objects.

A need exists for a system for forming metal particulate coatings that impart one or more physical properties to the object onto which they are coated.

A need exists for a system for forming metal particulate coatings on objects without emitting volatile organic compounds.

The present embodiments meet these needs.

BRIEF DESCRIPTION OF THE DRAWINGS

The detailed description will be better understood in conjunction with the accompanying drawings as follows.

Figure 1:
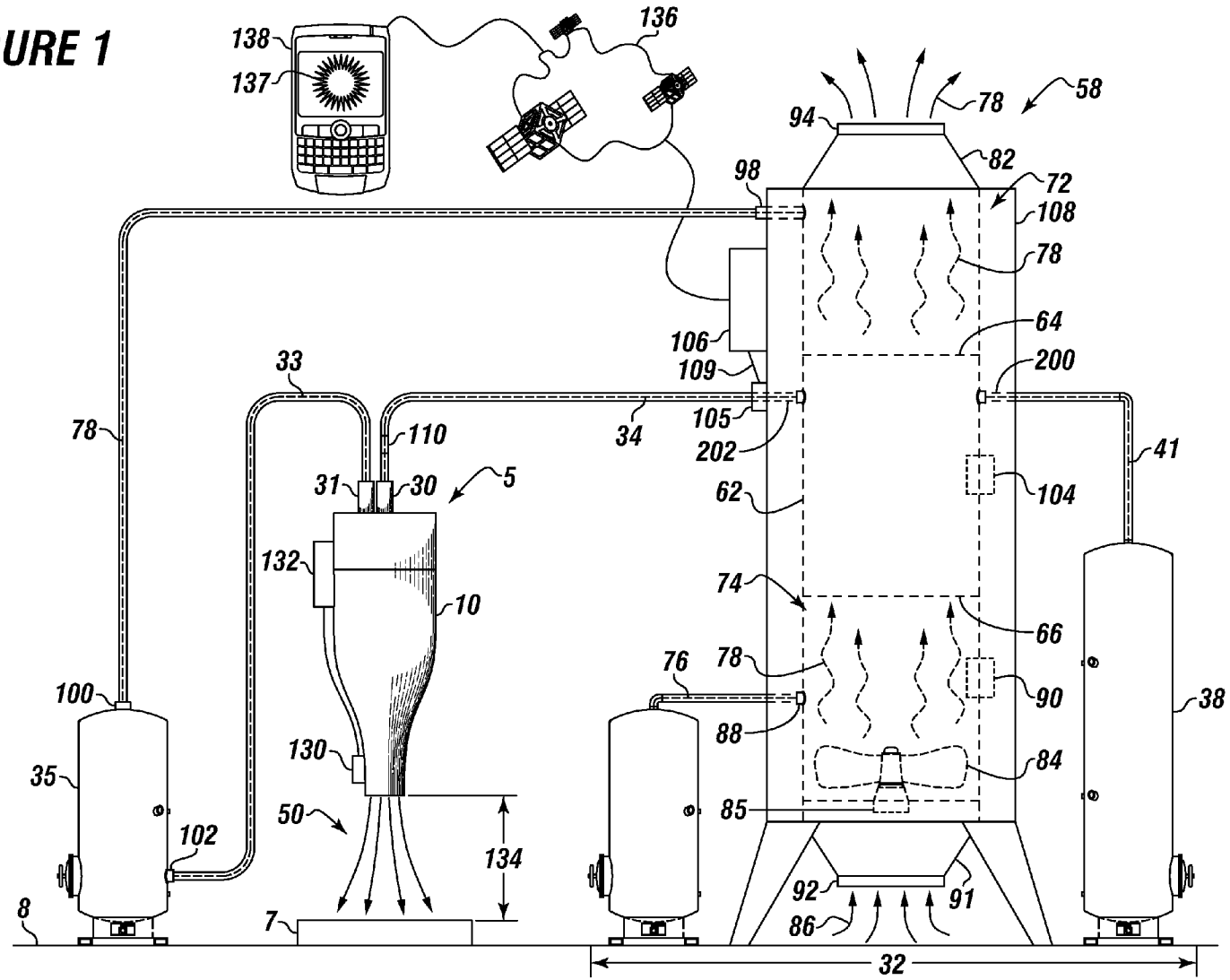
FIG. 1 depicts an embodiment of a system for spraying metal particulate onto an object to form a coating thereon.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The present embodiments generally relate to a system for spraying a metal particulate onto objects. The system can be used to apply a coating, deposit, or layer of the metal particulate onto a surface of the object. The coating can be applied to any desired thickness, for example a thickness from about 1 millimeter to about 10 millimeters.

The objects can include bridges, barges, ships, oil rigs, coker units, vapor recovery units, terrestrial pipelines, underwater pipelines, frac tanks, trailers, boat trailers, any metal surface, substrates, or the like.

The metal particulate can be aluminum particulate, copper particulate, titanium particulate, platinum particulate, a nickel alloy particulate, such as Monel™, a copper alloy particulate, an aluminum alloy particulate, a soft metal alloy particulate, any other metal particulate, or any metal shaving. The size of the metal particulate can be varied depending upon the particular application. For example, in one or more embodiments the metal particulate can range from about 0.50 milligrams (mg) to about 30.00 mg; however, the metal particulate can be larger or smaller. The term "soft alloy", as used herein in relation to metal alloys, can refer to metal alloys that are malleable.

The system can be used to provide a long lasting and durable coating on substrates, surfaces, and objects. For example, the coating can last for up to 100 years from the date that the coating is applied.

The coating can provide various physical properties to the substrate, surface, or object that it is applied to, such as increased impact resistance, increased thermal conductivity, reduced interference with heat transfer, and increased electrical conductivity. For example, a copper particulate can be applied as a coating onto an object having a lower electrical conductivity than copper, such as steel, which can increase the electrical conductivity of the object, such as by at least 10 percent.

The system can be used to provide a protective coating to substrates, surfaces, and objects of pure metal particulate using a hot pressurized air, without releasing volatile organic compounds into the atmosphere, thereby providing a safer and healthier environment for workers applying the coating, as well as to the surrounding public.

The coating can protect the objet from corrosion, surface damage, impact. The coating can be resistant to acidic corrosion, high temperature corrosion, and other forms of corrosion. For example, a titanium particulate coating on a pipe can increase the structural integrity of the pipe, allowing the pipe to withstand higher temperatures.

Additional objects can be welded onto the coating without compromising the structural integrity of the coating. For example, a steel pipe having an aluminum particulate coating can have stainless steel weld welded thereto.

The system can include a nozzle assembly in fluid communication with a metal particulate source and a hot pressurized air source.

The metal particulate can be contained within the metal particulate source, which can be used to provide the metal particulate to the nozzle assembly. The metal particulate source can be a container, which can be non-flammable and non-reactive. For example, the metal particulate source can be made of steel, corrosion resistant weld, or another material. The metal particulate source can be any size for containing any amount of metal particulate.

The hot pressurized air source can provide a hot pressurized air to the nozzle assembly. The temperature and pressure of the hot pressurized air can be varied depending upon the particular metal particulate and the object onto which the metal particulate is applied. The temperature of the hot pressured air can range from about 1500 degrees Fahrenheit to about 6000 degrees Fahrenheit, and the pressure of the hot pressured air can range from about 100 pounds per square inch (psi) to about 1000 psi. For example, the pressure of the hot pressurized air can be about 300 psi and the temperature of the hot pressurized air can be about 2000 degrees Fahrenheit when the system is used to spray aluminum particulate.

The nozzle assembly can include a nozzle cap, a tapered nozzle, and an outer tip. The nozzle assembly can be made of fused silica, ceramic, stainless steel, cobalt, titanium, chromium, or another material.

The nozzle cap can be cylindrical or another shape and can have a nozzle cap top side and a nozzle cap bottom side.

The tapered nozzle can be connected to the nozzle cap bottom side. For example, the tapered nozzle can be fastened, welded, bolted, threaded, or otherwise engaged with the nozzle cap bottom side. In one or more embodiments, the tapered nozzle and the nozzle cap can be an integral one-piece structure.

The tapered nozzle can have a wide end that can taper towards a nozzle tip opposite the wide end. The nozzle tip can be a flat faced tip. In one or more embodiments, the wide end can have a wide end diameter that is greater than a nozzle tip diameter. For example, the wide end diameter can be about 50 percent greater than the nozzle tip diameter. The tapered nozzle can also have an outer surface. The wide end diameter can range from about 1 inch to about 5 feet. The nozzle tip diameter can range from about ½ of an inch to about 2.5 feet.

An at least partially helical channel can be formed in or disposed on at least a portion of the outer surface adjacent the wide end. The helical channel can extend from the wide end towards the nozzle tip. For example, with a tapered nozzle having a wide end diameter of 1 inch, the helical channel can extend about 3 inches from the wide end. The helical channel can be a tapered recess in the outer surface that at least partially spirals about the outer surface from the wide end. The length, width, and depth of the helical channel can be configured to control the speed of a first vortex flow.

The outer tip can be connected to the nozzle cap bottom side. For example, the outer tip can be fastened, welded, bolted, threaded, or otherwise engaged with the nozzle cap bottom side. In one or more embodiments, the outer tip and the nozzle cap can be an integral one-piece structure.

The outer tip can have a first tip end and a second tip end. In one or more embodiments, the outer tip can be tapered, with the first tip end being wider than the second tip end. For example, the first tip end can have a width ranging from about 1 inch to about 5 feet, and the second tip end can have a width ranging from about 2 inches to about 10 feet. The first tip end can be connected to the nozzle cap bottom side. For example, the first tip end can be engaged flush with the nozzle cap bottom side.

The outer tip can include a venturi effect chamber at the first tip end. For example, the venturi effect chamber can be formed within the outer tip at the first tip end. The venturi effect chamber can include a chamber wall with a first rifling. The first rifling can extend around the chamber wall. For example, the first rifling can extend from the first tip end into the venturi effect chamber. The first rifling can be spiral or helical grooves extending along the chamber wall. In operation, the first rifling can function to cause an at least partially spiraling flow path of the metal particulate and/or the hot pressurized air within the venturi effect chamber; enhancing mixing of the metal particulate with the hot pressurized air and increasing a velocity of the metal particulate and/or the hot pressurized air.

With the outer tip connected to the nozzle cap, the tapered nozzle can be disposed within the venturi effect chamber. In one or more embodiments, the tapered nozzle can be disposed within the venturi effect chamber without engaging the chamber wall.

The outer tip can include a mixing conduit in fluid communication with the venturi effect chamber. The venturi effect chamber can be tapered, and can taper from the first tip end towards the mixing conduit. The mixing conduit can fluidly connect at a first end with the venturi effect chamber, and can extend through the outer tip towards the second tip end. The mixing conduit can have a nozzle orifice at the second tip end.

The mixing conduit can have an interior wall with a second rifling extending around the interior wall. The second rifling can be formed substantially similar to the first rifling. In one or more embodiments, the first rifling and the second rifling can have the same density of threads per length or a different density of threads per length. In one or more embodiments, the first rifling and the second rifling can be the same rifling extending continuously from the first tip end, along the chamber wall, along the interior wall, and to the second tip end.

The nozzle assembly can include a particulate channel that can extend or pass through the nozzle cap. For example, the particulate channel can be a through hole. The particulate channel can have a first opening at the nozzle cap top side, and a second opening at the nozzle cap bottom side. The second opening of the particulate channel can be disposed proximate the helical channel. The particulate channel can be in fluid communication with the metal particulate source for receiving the metal particulate and flowing the metal particulate into the venturi effect chamber proximate the helical channel.

The nozzle assembly can include a tapered channel that can extend or pass through the nozzle cap and the tapered nozzle. For example, the nozzle assembly can be a through hole, and can extend from the nozzle cap top side, through the nozzle cap, through the tapered nozzle, and to the nozzle tip. The tapered channel can pass axially from a centered top opening in the nozzle cap to the nozzle tip. The tapered channel can have a constant diameter within the nozzle cap, and a gradually reducing tapered diameter within the tapered nozzle ranging from about 1/32 of an inch to about 10 inches. The particulate channel can be offset from the tapered channel.

In one or more embodiments, the particulate channel can be in fluid communication with the metal particulate source through a conduit at least partially disposed within the particulate channel for controlled introduction of the metal particulate into to the nozzle assembly.

The tapered channel can be in fluid communication with the hot pressurized air source through a hot air conduit at least partially disposed within the tapered channel for controlled introduction of the hot pressurized air into to the nozzle assembly. The conduit and the hot air conduit can both be flexible and configured to allow a user to maneuver the nozzle assembly for applying the metal particulate to objects and/or surfaces.

The conduit and the hot air conduit can both be threadably engaged with the nozzle assembly, such as with the tapered channel and the particulate channel. The conduit and the hot air conduit can be fumed silica tubes, ceramic tubes, stainless steel tubes, titanium tubes, tungsten tubes, or another material or metal capable of withstanding high temperatures. In operation, thermal expansion can expand the conduit and the hot air conduit forming a seal against the inner walls of the tapered channel and the particulate channel.

The tapered channel can be in fluid communication with the venturi effect chamber. For example, the nozzle tip can have an opening providing fluid communication from the tapered channel to the venturi effect chamber.

The tapered channel can be in fluid communication with the hot pressurized air source for receiving the hot pressurized air, flowing the hot pressurized air to the nozzle tip, and expelling the hot pressurized air out of the nozzle tip into the venturi effect chamber. In operation, as the hot pressurized air flows out of the nozzle tip into the venturi effect chamber, a venturi effect can be formed at or proximate the nozzle tip. The venturi effect can draw in the metal particulate from the metal particulate source through the particulate channel.

The helical channel can be configured to form the first vortex flow as the metal particulate flows from the particulate channel. For example, as the metal particulate flows past the helical channel, at least a portion of the metal particulate can flow along the helical channel forming the first vortex flow of the metal particulate.

The combination of the venturi effect and the first vortex flow can cause the metal particulate to flow along an at least partially spiraling flow path from the particulate channel to or proximate the nozzle tip. Within the venturi effect chamber, such as at or proximate the nozzle tip, the metal particulate and the hot pressurized air can at least partially mix together, forming an air metal mixture.

The metal particulate, the hot pressurized air, and/or the air metal mixture can flow from the venturi effect chamber into the mixing conduit. The mixing conduit can be configured to form a second vortex flow of the metal particulate, the hot pressurized air, and/or the air metal mixture. The second vortex flow can be formed by the second rifling. The mixing conduit can further mix any unmixed metal particulate and hot pressurized air, further forming the air metal mixture.

The nozzle orifice can be configured to expel the air metal mixture. In operation, the second rifling can function to cause an at least partially spiraling flow path of the air metal mixture within the mixing conduit, further mixing the metal particulate with the hot pressurized air, and increasing a velocity of the air metal mixture.

In one or more embodiments, the mixing conduit can have a tapered conduit diameter. For example, the mixing conduit can have a tapered conduit diameter that is greater at the second tip end than at the first tip end. The tapered conduit diameter can be greater than the constant diameter and the gradually reducing diameter of the tapered nozzle.

In operation, the tapered diameter of the mixing conduit can function to ensure that the velocity of the air metal mixture is not substantially reduced.

The air metal mixture can flow out of the mixing conduit through the nozzle orifice for application onto one or more objects or surfaces. For example, the speed of the air metal mixture can range from about 100 miles per hour up to supersonic speeds. The speed, pressure, and temperature at which the air metal mixture flows from the nozzle orifice can be at least partially controlled using the hot pressurized air from the hot pressurized air source.

The combination of the temperature and pressure provided from the hot pressurized air to the metal particulate can provide the metal particulate within the air metal mixture with enough energy to at least partially bond with objects upon impact therewith. For example, upon impact the metal particulate within the air metal mixture can be at least partially softened due to the temperature of the air metal mixture. The high pressure of impact of the metal particulate with the object can further soften the metal particulate; thereby causing physical and/or chemical bonding of the metal particulate with the object.

In one or more embodiments, the metal particulate can be in a solid state prior to and upon impact with the object, as opposed to being in a liquid state or a vaporized state. As such, the system can use solid metal particulate, such as metal shavings, to form a coating, layer, and/or deposit of the solid metal particulate on objects. The object can be at ambient temperature, requiring no pre-heating before being sprayed with the metal particulate.

After impact with the object, the temperature of the metal particulate can come to equilibrium with the temperature of the object. As such, the metal particulate can form a coating, layer, and/or deposit upon the object that is chemically and/or physically bonded thereto. The coating, layer, and/or deposit can remain chemically/physically bonded on the object.

In one or more embodiments, the hot air source can include a compressed air source for providing compressed air to a heat exchanger in communication with the compressed air source. The heat exchanger can also be in communication with the tapered channel, such as through the hot air conduit. The heat exchanger can be configured to heat the compressed air to form the hot pressurized air.

The heat exchanger can include a protective shell, which can be a fiberglass insulated sleeve or another rigid material. The protective shell can encase a heat exchanger housing assembly disposed therein.

The heat exchanger housing assembly can include a compressed air inlet extending or passing through the protective shell. The compressed air inlet can be in fluid communication with the compressed air source for receiving the compressed air therefrom.

The heat exchanger housing assembly can include a silicon carbide member having a silicon carbide member top side and a silicon carbide member bottom side.

At least one helical heat exchanger channel can be formed within or encased within the silicon carbide member. For example, the helical heat exchanger channel can be a channel formed directly in the silicon carbide member, or can be a tubing encased within the silicon carbide member. The tubing can be metal tubing, such as steel or titanium tubing. The helical heat exchanger channel can be a coiled conduit passing through the silicon carbide member. A first end of the helical heat exchanger channel can be in fluid communication with the compressed air inlet for receiving the compressed air therefrom.

The silicon carbide member can have a plurality of hot air channels that can extend therethrough from the silicon carbide member top side to the silicon member bottom side. In one or more embodiments the plurality of hot air channels can extend parallel to one another. The plurality of hot air channels can extend through the silicon carbide member such that none of the plurality of hot air channels intersect with the helical heat exchanger channel.

The heat exchanger housing assembly can include a combustion chamber at the silicon carbide member bottom side. The combustion chamber can be connected to the silicon carbide member bottom side. The connection between the combustion chamber and the silicon carbide member bottom side can be sealed.

The combustion chamber can be made of steel or any material capable of withstanding high temperatures, and can include an air inlet for receipt of air from outside of the combustion chamber. A fan can be in the air inlet for drawing in the air from outside of the combustion chamber. The combustion chamber can include a gas conduit for flowing a fuel into the combustion chamber. As such, the fuel and air can mix within the combustion chamber. The fuel can be natural gas, gasoline, propane, diesel fuel, acetylene, hydrogen gas, or another flammable substance.

The combustion chamber can include an ignition source for igniting the mixture of the fuel and air. The ignition source can be an electrical arc. The electric arc can initiate burning of the fuel and air. The burning mixture of fuel and air can form a hot gas within the combustion chamber.

The plurality of hot air channels can be in fluid communication with the combustion chamber for receiving the hot gas. The hot gas can flow through the plurality of hot air channels and transfer heat through the silicon carbide member to the compressed air within the helical heat exchanger channel, forming the hot pressurized air.

The heat exchanger housing assembly can include an exhaust chamber at the silicon carbide member top side, which can be made of steel or any material capable of withstanding high temperatures. The exhaust chamber can be connected to the silicon carbide member bottom side. The connection between the exhaust chamber and the silicon carbide member bottom side can be sealed.

The exhaust chamber can be in fluid communication with the plurality of hot air channels for receiving the hot gas and exhausting the hot gas therefrom. The hot gas can flow from the combustion chamber, through the silicon carbide member, and into the exhaust chamber.

The heat exchanger housing assembly can include a hot pressurized air outlet extending or passing through the protective shell, and in fluid communication with a second end of the helical heat exchanger channel. As such, the formed hot pressurized air can flow from the helical heat exchanger channel out of the hot pressurized air outlet to the hot air conduit, and through the hot air conduit into the tapered channel of the nozzle assembly.

In one or more embodiments, the metal particulate source can be in fluid communication with the exhaust chamber for receiving at least a portion of the hot gas therefrom. A filter can be disposed between the exhaust chamber and the metal particulate source. The filter can be configured to: receive the hot gas from the exhaust chamber, filter the hot gas, and transmit the hot gas to the metal particulate source to preheat the metal particulate before flowing the metal particulate into the nozzle assembly. The filter can filter sparks or other hot materials from the hot gas to prevent the sparks or other hot materials from entering the metal particulate source. For example, the filter can be a steel mesh filter.

One or more embodiments of the system can include one or more temperature sensors for measuring a temperature of the hot pressurized gas. For example, the system can include a first temperature sensor embedded within the silicon carbide member, a second temperature sensor in the hot air conduit adjacent the hot pressurized air outlet, a third temperature sensor in the hot air conduit adjacent the tapered channel, other temperature sensors, or combinations thereof.

The system can include a microcontroller, which can be mounted to the protective shell and in communication with one or more of the temperature sensors for receiving sensed temperatures therefrom.

The microcontroller can include a processor in communication with a data storage. The data storage can include various data and computer instructions stored therein.

The data storage can include computer instructions to receive and store the sensed temperatures. For example, the temperature sensors can sense the temperature of the hot pressurized air, and can transmit that sensed temperature to the microcontroller. The computer instructions in the data storage can instruct the microcontroller to store the sensed temperature within the data storage.

The data storage can have preset data stored therein for comparison to the sensed temperature. For example, the data storage can have at least one preset maximum temperature stored therein. The data storage can have a preset maximum temperature for each metal particulate that the system is configured to spray. The microcontroller and the data storage can be updated to include preset data for metal particulate not previously stored within the data storage. Each preset maximum temperature can be a maximum temperature that the hot pressurized air should reach during operation of the system for spraying the object. Each particular metal particulate can have the same or a different preset maximum temperature. For example, the preset maximum temperature for aluminum can be 3000 degrees Fahrenheit.

The data storage can have at least one preset minimum temperature stored therein. Each preset minimum temperature can be a minimum temperature that the hot pressurized air should reach during operation of the system for spraying the object. Each particular metal particulate can have the same or a different preset minimum temperature. For example, the preset minimum temperature for aluminum can be 1700 degrees Fahrenheit.

The data storage can have at least one optimum operational temperature stored therein. Each optimum operational temperature can be an optimum temperature that the hot pressurized air should be during operation of the system for spraying the object. Each particular metal particulate can have the same or a different optimum operational temperature. The optimum operational temperature can be optimized to provide the appropriate temperature to form the coating, layer, or deposit without forming an oxide of the metal particulate. For example, the optimum operational temperature for aluminum can be 2000 degrees Fahrenheit.

In operation a user can instruct the microcontroller as to which metal particulate that the user is spaying with the system, such as by selecting the particular metal particulate from a list or menu on a display of the microcontroller. The microcontroller can associate the selected metal particulate with an optimum operational temperature, a preset maximum temperature, and a preset minimum temperature stored within the data storage.

The data storage can include computer instructions to compare each sensed temperature to: at least one preset maximum temperature, at least one preset minimum temperature, at least one optimum operational temperature, or combinations thereof. For example, the numerical value of the sensed temperature can be compared to the preset maximum temperature to determine whether or not the sensed temperature has exceeded the preset maximum temperature. The numerical value of the sensed temperature can be compared to the preset minimum temperature to determine whether or not the sensed temperature has fallen below the preset minimum temperature. The numerical value of the sensed temperature can be compared to the optimum operational temperature to determine whether or not the sensed temperature is equivalent to the optimum operational temperature.

The data storage can include computer instructions to initiate an alarm when any of the sensed temperatures exceed at least one of the preset maximum temperatures, or falls below at least one of the preset minimum temperatures. For example, after the comparison is performed and it is determined that either a sensed temperature exceeds a preset maximum temperatures or falls below a preset minimum temperature, a signal can be transmitted from the microcontroller to an alarm. The alarm can be an audio alarm, a visual alarm, or combinations thereof, and can be in communication with the microcontroller. In one or more embodiments, the alarm can be an audio and/or visual signal on a client device.

The data storage can include computer instructions to shut down the hot pressurized air source when any of the sensed temperatures exceeds the at least one preset maximum temperature, or falls below the at least one preset minimum temperature. For example, the microcontroller can be in communication with one or more safety shut off valves of the system, and can electronically control the safety shut off valves for closure upon a determination that the sensed temperature either exceeded a preset maximum temperatures or fell below a preset minimum temperature. The microcontroller can also be in communication with one or more power sources that provide power to one or more portions of the system. Upon a determination that the sensed temperature either exceeded a preset maximum temperature or fell below a preset minimum temperature, the microcontroller can electronically control the power sources to shut off power to the system.

In one or more embodiments, the microcontroller can be in communication with a client device through a network for remote monitoring and management. The client device can be a mobile phone, computer tablet, laptop, computer, or another communication device. The network can be a satellite network, cellular network, the Internet, another communications network, or combinations thereof. In operation, a user, such as a foreman or manager, can monitor the status of the system, such as the sensed temperature, on a display of the client device. Additionally, the user performing the spraying can also monitor the status of the system, such as on the display of the microcontroller or on another client device.

On or more embodiments of the system can include a first safety shut off valve on the air inlet. The first safety shut off valve can be a one-way valve mechanically configured to prevent flow of the air from the combustion chamber, but to allow flow of air into the combustion chamber.

The system can include a second safety shut off valve on the exhaust chamber. The second safety shut off valve can be a one-way valve mechanically configured to prevent flow of the air into the exhaust chamber, but to allow flow of the hot gas out of the exhaust chamber.

The system can include a third safety shut off valve on the metal particulate source. The third safety shut off valve can be in fluid communication with an interior of the metal particulate source and with the exhaust chamber or another source of hot air. The third safety shut off valve can allow the hot gas to flow into the metal particulate source from the exhaust chamber to preheat the metal particulate.

The system can include a fourth safety shut off valve on the metal particulate source, which can be in fluid communication with the interior of the metal particulate source and with the particulate channel, such as through the conduit. The fourth safety shut off valve can allow the metal particulate to flow to the nozzle assembly. The fourth safety shut off valve can be a one way valve mechanically configured to prevent flow from the nozzle assembly into the metal particulate source, but to allow flow from the metal particulate source to the nozzle assembly.

One or more of the safety shut off valves can be electronic, and can be in communication with the microcontroller. The microcontroller can control one or more of the safety shut off valves. For example, the computer instructions to shut down the hot pressurized air source can function in part by instructing the microcontroller to close one or more of the safety shut off valves of the system, and by instructing the microcontroller to shut down power to the fan and/or other portions of the system.

One or more embodiments can include a distance sensor disposed on the outer tip and configured to measure a distance between the outer tip and the object and/or surface. For example, the distance sensor can be an optical sensor, a laser range finder, or another distance indicator. An indicator can be in communication with the distance sensor for indicating when the outer tip is and is not at a predetermined distance from the object and/or surface. The indicator can be a visual indicator, such as a light, a textual display, or a graphical display. The indicator can also be an audible indicator, such as a speaker. The indicator can be disposed on the outer tip. In one or more embodiments, the distance sensor can be in communication with the microcontroller and/or the client device for remote monitoring of the distance between the outer tip and the object.

The predetermined distance can be a distance configured to ensure an optimal speed and temperature of the air metal mixture upon impact with the object.

In operation, to set up the system for use, a user can connect a gas conduit to the heat exchanger for supplying the fuel thereto. The user can connect a high pressure, low temperature air line to the heat exchanger, such as a line from the compressed air source, for supplying the compressed air thereto. The user can connect a high temperature, high pressure line between the nozzle assembly and the heat exchanger, such as the hot air conduit, to transmit the hot pressurized air from the heat exchanger to the nozzle assembly. The user can connect a metal particle suction line between the nozzle assembly and the metal particle source for supplying the metal particulate to the nozzle assembly, such as through the conduit. The user can connect an electrical input line, such as a power cord, to a power input of the system to provide power to the system.

To perform spraying operations with the system, the user can select an appropriate metal particulate that is to be sprayed. The user can ensure that the metal particulate source contains the appropriate metal particulate, and can inform the microcontroller of the appropriate metal particulate that will be sprayed by the system. The user can turn on the system while holding the nozzle assembly close to the object, such as at the predetermined distance, which can be programmed into a programmed optimal distance code program in the microcontroller. The user can move the nozzle assembly about to ensure coverage over the entire object to finish the spraying operation.

If at any time during the spraying operation the user pulls the bottom tip end of the nozzle assembly away from the object and outside of the predetermined distance, the microcontroller can be configured to recognize this, such as by using the distance sensor, and the microcontroller can close a valve controlling the low temperature, high pressure air flow line to cease operations of the system. The microcontroller can be configured such that it will not allow the system to resume spraying operations until the bottom tip end of the nozzle assembly is back within the predetermined distance from the object.

Turning now to the Figures, FIG. 1 depicts an embodiment of a system for applying a metal particulate 33 onto an object 8.

The system can include a spraying device 5, which can include a nozzle assembly 10.

The system can include a metal particulate source 35, which can contain the metal particulate 33. The metal particulate source 35 can be in fluid communication with the nozzle assembly 10 for providing the metal particulate 33 thereto, such as through the conduit 31.

The spraying device 5 can also be in fluid communication with a hot pressurized air source 32. The hot pressurized air source 32 can provide a hot pressurized air 34 to the spraying device 5, such as through the hot pressurized air conduit 30. The hot pressurized air source 32 can include a compressed air source 38 with compressed air 41, and a heat exchanger 58. The compressed air source 38 can be in fluid communication with the heat exchanger 58, such as through a compressed air inlet 200, and the heat exchanger 58 can be configured to heat the compressed air 41 to form the hot pressurized air 34.

The heat exchanger 58 can include a protective shell 108, through which the compressed air inlet 200 can pass. A heat exchanger housing assembly 72 can be disposed within the protective shell 108. The heat exchanger housing assembly 72 can include a silicon carbide member 62, a combustions chamber 74, and an exhaust chamber 82. The combustion chamber 74 can be engaged with the silicon carbide member bottom side 66, and the exhaust chamber 82 can be engaged with the silicon carbide member top side 64.

The combustion chamber 74 can include an air inlet 91 with a fan 84 for flowing air 86 from outside of the combustion chamber 74 to inside the combustion chamber 74. A power source 85 can be in communication with the fan 84 and with other portions of the system for providing power thereto. A first safety shut off valve 92 can be on the air inlet 91. The first safety shut off valve 92 can be a one-way valve mechanically configured to prevent flow of the air 86 from the combustion chamber 74.

The combustion chamber 74 can include a gas conduit 88 for receiving a fuel 76, and flowing the fuel 76 into the combustion chamber 74. The fuel 76 and the air 86 can mix within the combustion chamber 74. The combustion chamber 74 can include can include an ignition source 90 for igniting the fuel 76 and air 86 within the combustion chamber 74, forming a hot gas 78.

The combustion chamber 74 can be in fluid communication with the exhaust chamber 82 through the silicon carbide member 62, allowing the hot gas 78 to flow through the silicon carbide member 62, into the exhaust chamber 82, and out of the exhaust chamber 82 through a second safety shut off valve 94 on the exhaust chamber 82. The second safety shut off valve 94 can be a one-way valve mechanically configured to prevent flow, such as of the air 86, into the exhaust chamber 82 from outside of the protective shell 108.

In operation, the compressed air 41 can flow from the compressed air source 38 and through the silicon carbide member 62. As the hot gas 78 flows through the silicon carbide member 62, heat from the hot gas 78 can be transferred to the compressed air 41, forming the hot pressurized air 34. The hot pressurized air 34 can flow from the silicon carbide member 62 through a hot pressurized air outlet 202 disposed through the protective shell 108. The hot pressurized air 34 can flow from the hot pressurized air outlet 202 into the nozzle assembly 10.

The spraying device 5 can be configured to receive the metal particulate 33 from the metal particulate source 35, such as through the conduit 31. The spraying device 5 can also receive the hot pressurized air 34 from the hot pressurized air source 32, such as through the hot pressurized air conduit 30. The spraying device 5 can mix the metal particulate 33 with the hot pressurized air 34, such as within the nozzle assembly 10, forming an air metal mixture 50. The spraying device 5 can be configured to expel the air metal mixture 50 onto the object 8, thereby forming a coating, layer, and/or deposit 7 thereon.

The nozzle assembly 10 can have a distance sensor 130 disposed thereon, such as on an outer tip of the nozzle assembly 10. The distance sensor 130 can be an optical sensor, a laser range finder, or another distance sensor. The distance sensor 130 can be configured to measure a distance between the outer tip of the nozzle assembly 10 and the object 8. An indicator 132 can be in communication with the distance sensor 130 for indicating when the outer tip of the nozzle assembly 10 is or is not at a predetermined distance 134 from the object 8. The predetermined distance 134 can be a distance configured to ensure an optimal speed and temperature of the air metal mixture 50 upon impact with the object 8.

In one or more embodiments, the exhaust chamber 82 can be in fluid communication with the metal particulate source 35, such as through a third safety shut off valve 100 on the metal particulate source 35. The hot gas 78 can flow from the exhaust chamber 82, through a filter 98, through the third safety shut off valve 100, and into the metal particulate source 35 to preheat the metal particulate 33. The filter 98 can remove sparks and other hot objects from the hot gas 78 before transmission of the hot gas 78 to the metal particulate source 35.

The metal particulate 33 can then flow from the metal particulate source 35, through a fourth safety shut off valve 102 on the metal particulate source 35 to the nozzle assembly 10. The fourth safety shut off valve 102 can be a one-way valve mechanically configured to prevent flow into the metal particulate source 35.

One or more embodiments of the system can include a first temperature sensor 104 embedded within the silicon carbide member 62, a second temperature sensor 105 in the hot air conduit 30 adjacent the hot pressurized air outlet 202, and a third temperature sensor 110 in the hot air conduit 30 adjacent a tapered channel of the nozzle assembly 10.

A microcontroller 106 can be mounted to the protective shell 108 and can be in wired or wireless communication with the first temperature sensor 104, the second temperature sensor 105, the third temperature sensor 110, or combinations thereof for receiving sensed temperatures 109 therefrom.

The microcontroller 106 can be in communication with a client device 138 through a network 136 for remote monitoring and management of the system. For example, the microcontroller can transmit the sensed temperatures 109 and an alarm 137 to the client device 138.

The microcontroller 106 can also be in wired or wireless communication with the power source 85, the first safety shut off valve 92, the second safety shut off valve 94, the third safety shut off valve 100, the fourth safety shut off valve 102, the distance sensor 130, and the ignition source 90. As such, the microcontroller 106 can be used to monitor and/or control each valve, sensor, and component that it is in communication with.

Figure 2A:
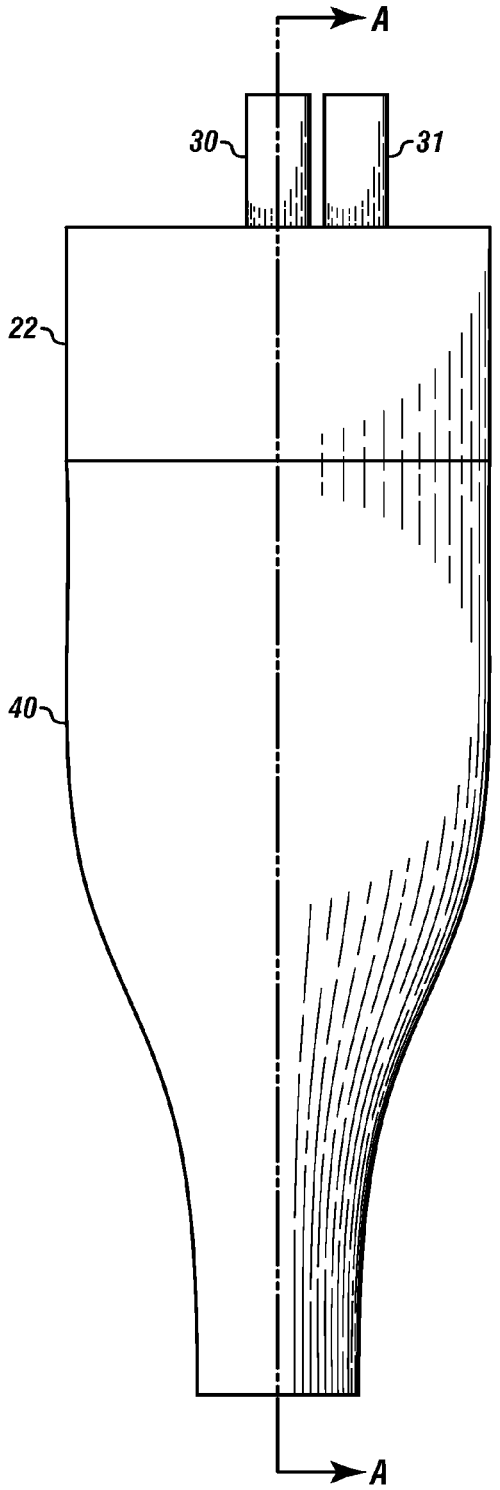
FIGS. 2A-2B depict an embodiment of a nozzle assembly of the system.
Figure 2B:
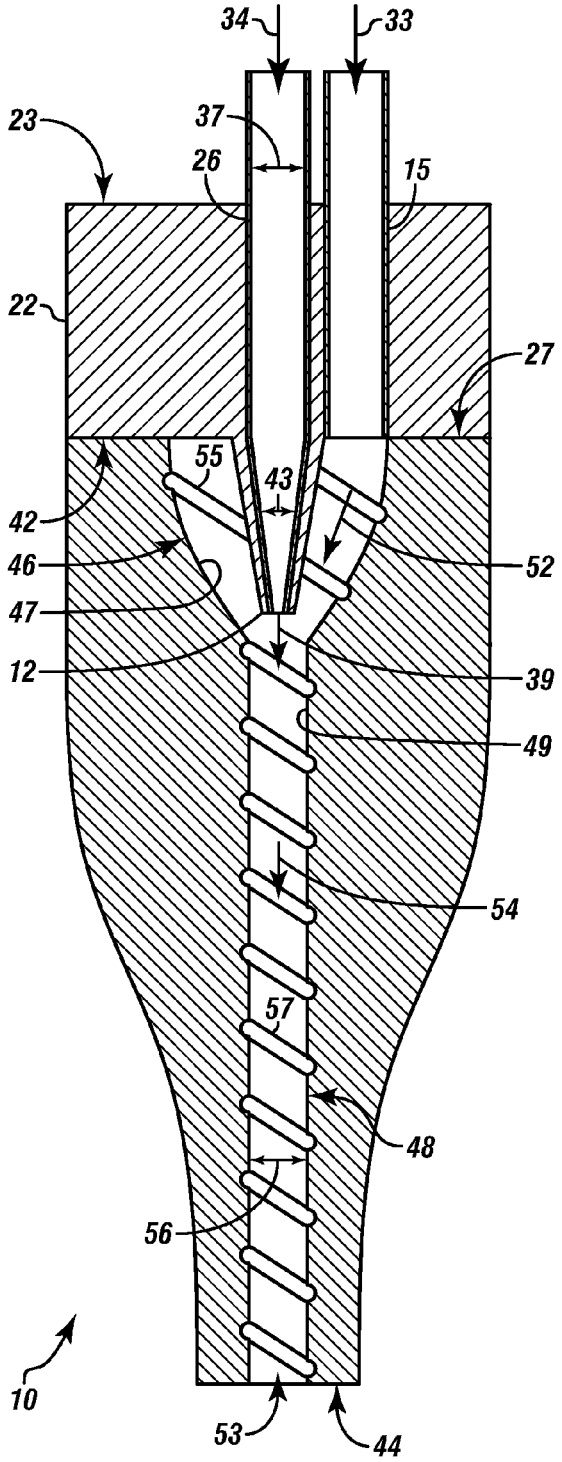

FIG. 2A depicts the nozzle assembly 10, and FIG. 2B depicts a cut view of the nozzle assembly 10. The nozzle assembly 10 can include a nozzle cap 22 connected to an outer tip 40.

The nozzle cap 22 can have a nozzle cap top side 23, a nozzle cap bottom side 27, and a tapered nozzle 12 connected to the nozzle cap bottom side 27.

The outer tip 40 can have a first tip end 42 and a second tip end 44. The first tip end 42 can be connected to the nozzle cap bottom side 27. The outer tip 40 can have a venturi effect chamber 46 at the first tip end 42. The tapered nozzle 12 can extend from the nozzle cap bottom side 27 into the venturi effect chamber 46 without engaging the venturi effect chamber 46.

A particulate channel 15 can be disposed through the nozzle cap 22. The particulate channel 15 can have a first opening at the nozzle cap top side 23 and a second opening at the nozzle cap bottom side 27 proximate the helical channel (shown in FIG. 3). The particulate channel 15 can be in fluid communication with the metal particulate source, such as through the conduit 31, which can be at least partially disposed within the particulate channel 15 for controlled introduction of the metal particulate 33 into to the venturi effect chamber 46.

A tapered channel 26 can extend from the nozzle cap top side 23 to a nozzle tip of the tapered nozzle 12. The tapered channel 26 can have a constant diameter 37 extending from the nozzle cap top side 23 to the nozzle cap bottom side 27, and a tapered diameter 43 extending from the nozzle cap bottom side 27 to the nozzle tip of the tapered nozzle 12.

A hot air conduit 30 can be at least partially disposed within the tapered channel 26 and in fluid communication with the hot air source for controlled introduction of the hot pressurized air 34 into the venturi effect chamber 46.

The conduit 31 and the hot air conduit 30 can both be flexible and configured to allow a user to orient and adjust a direction of the nozzle assembly 10 for controlled expulsion of the air metal mixture onto objects.

The venturi effect chamber 46 can have a chamber wall 47 with a first rifling 55 extending around the chamber wall 47.

A mixing conduit 48 can be in fluid communication with the venture effect chamber 46. The mixing conduit 48 can have an interior wall 49 with a second rifling 57 extending around the interior wall 49. The mixing conduit 48 can have a nozzle orifice 53 at the second tip end 44 for expelling the air metal mixture from the mixing conduit 48.

The mixing conduit 48 can have a tapered conduit diameter 56 that is larger at the second tip end 44 than proximate to the venturi effect chamber 46.

In operation, the tapered channel 26 can receive the hot pressurized air 34 and expel the hot pressurized air 34 at the nozzle tip of the tapered nozzle 12, forming a venturi effect 39 that draws or sucks the metal particulate 33 into the particulate channel 15. The helical channel (shown in FIG. 3) and the venturi effect chamber 46 with the first rifling 55 can be configured to form a first vortex flow 52 as the metal particulate 33 flows from the particulate channel 15 into the venturi effect chamber 46. The mixing conduit 48 with the second rifling 57 can be configured to form a second vortex flow 54 of the air metal mixture.

Figure 3:
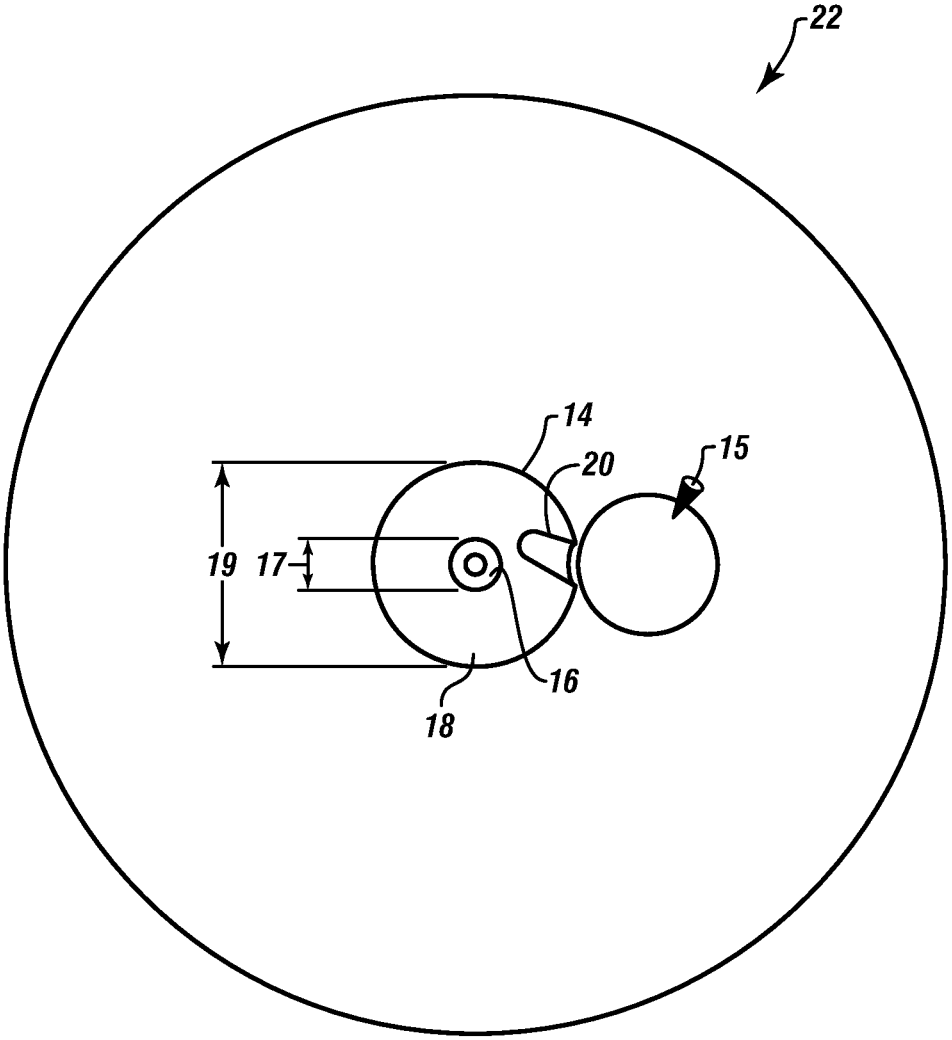
FIG. 3 depicts a bottom view of a nozzle cap of the nozzle assembly.

FIG. 3 depicts a bottom view of the nozzle cap 22 with the tapered nozzle having a wide end 14 opposite the nozzle tip 16. The wide end 14 can have a wide end diameter 19 that is greater than a tapered nozzle diameter 17 of the nozzle tip 16.

The tapered nozzle can have an outer surface 18. The helical channel 20 can be formed on the outer surface 18. The opening of the particulate channel 15 can be disposed adjacent the helical channel 20. The helical channel 20 can extend toward the nozzle tip 16.

Figure 4A:
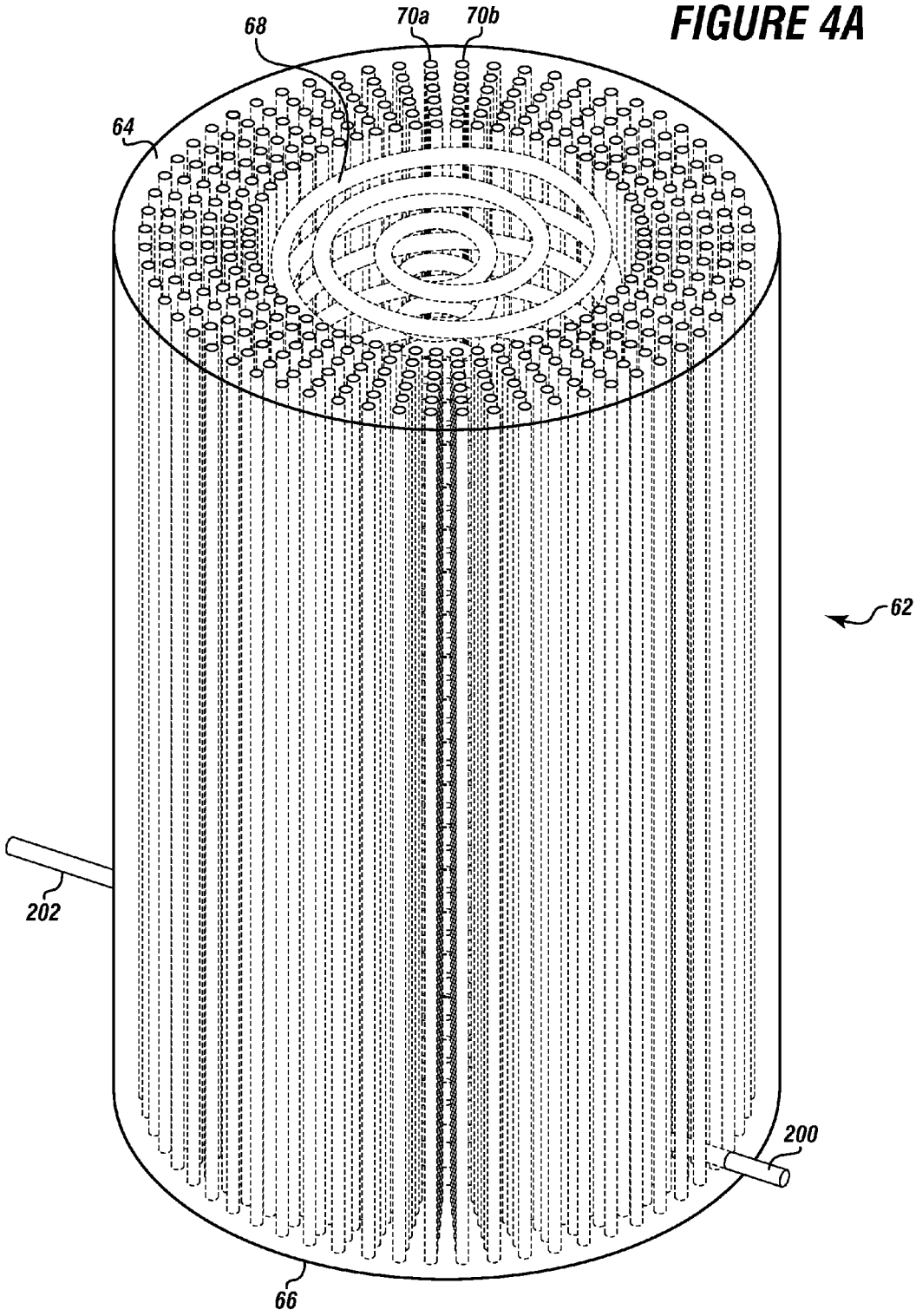
FIGS. 4A-4C depict a silicon carbide member with a helical heat exchanger channel and hot air channels.
Figure 4C:
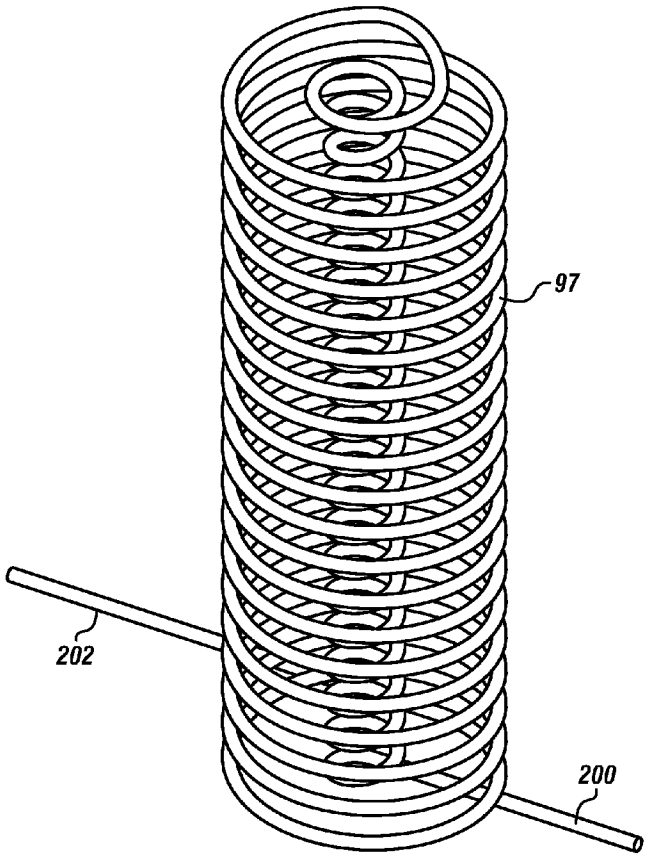
Figure 4B:
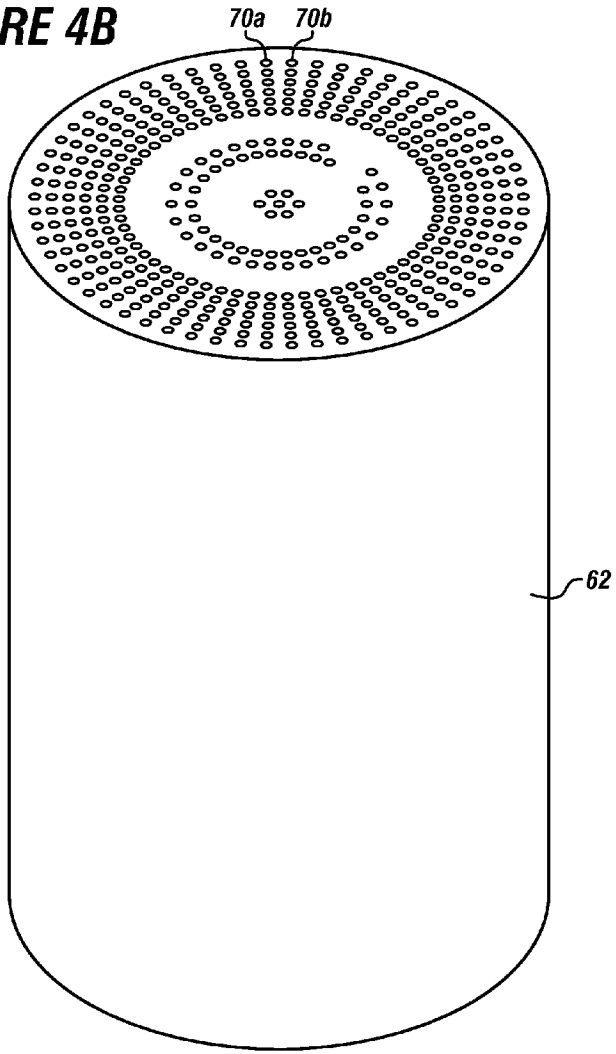

FIGS. 4A, 4B, and 4C depict an embodiment of the silicon carbide member 62 having a silicon carbide member top side 64 and a silicon carbide member bottom side 66.

A helical heat exchanger channel 68 can be formed or disposed within the silicon carbide member 62 and in fluid communication with the compressed air inlet 200 and the hot pressurized air outlet 202. In one or more embodiments, a metal tubing 97 can be disposed in the helical heat exchanger channel 68.

A plurality of hot air channels, including hot air channels 70*a* and 70*b*, can extend from the silicon carbide member top side 64 to the silicon carbide member bottom side 66. The hot air channels 70*a* and 70*b* can be in fluid communication with the combustion chamber to transfer heat from the hot gas in the combustion chamber to the compressed air within the helical heat exchanger channel 68, forming the hot pressurized air. The hot air channels 70*a* and 70*b* can also be in fluid communication with the exhaust chamber for exhausting the hot gas from the silicon carbide member 62.

Figure 5:
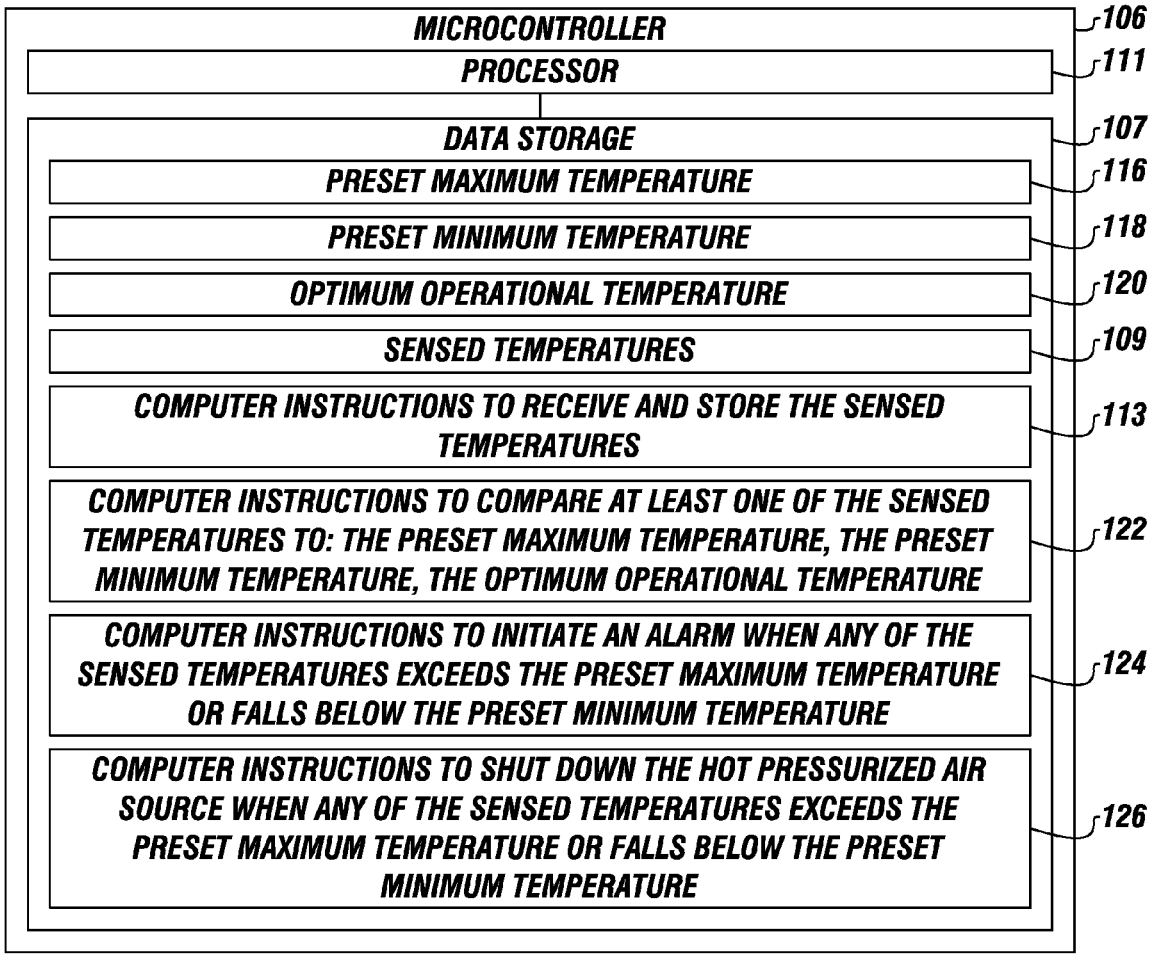
FIG. 5 depicts an embodiment of a microcontroller of the system.

FIG. 5 depicts an embodiment of the microcontroller 106. The microcontroller 106 can include a processor 111 in communication with a data storage 107.

The data storage 107 can include a preset maximum temperature 116, a preset minimum temperature 118, an optimum operational temperature 120, and sensed temperatures 109 stored therein.

The optimum operational temperature 120 can be an optimum temperature for the hot pressurized air during application of a particulate metal particulate onto the object. The preset maximum temperature 116 can be a maximum temperature for the hot pressurized air during application of the particulate metal particulate onto the object. The preset minimum temperature 118 can be a minimum temperature for the hot pressurized air during application of the particulate metal particulate onto the object.

The data storage 107 can include computer instructions to receive and store the sensed temperatures 113.

The data storage 107 can include computer instructions to compare at least one of the sensed temperatures to: the preset maximum temperature, the preset minimum temperature, and the optimum operational temperature 122.

The data storage 107 can include computer instructions to initiate an alarm when any of the sensed temperatures exceeds the preset maximum temperature or falls below the preset minimum temperature 124.

The data storage 107 can include computer instructions to shut down the hot pressurized air source when any of the sensed temperatures exceeds the preset maximum temperature or falls below the preset minimum temperature 126.

In one or more embodiments, the computer instructions to shut down the hot pressurized air source when any of the sensed temperatures exceeds the preset maximum temperature or falls below the preset minimum temperature 126 can be configured to close all of the safety shut off valves of the system, and to shut down power to the fan.

While these embodiments have been described with emphasis on the embodiments, it should be understood that within the scope of the appended claims, the embodiments might be practiced other than as specifically described herein.

What is claimed is:

1. A system for applying a metal particulate onto an object, the system comprising:

a. a metal particulate source for providing the metal particulate:

b. a hot pressurized air source for providing a hot pressurized air, wherein the hot pressurized air source comprises a compressed air source and a heat exchanger in communication with the compressed air source, and wherein the heat exchanger comprises a protective shell; a compressed air inlet disposed through the protective shell and in fluid communication with the compressed air source for receiving compressed air; a heat exchanger housing assembly within the protective shell comprising: a silicon carbide member comprising: a silicon carbide member top side and a silicon carbide member bottom side; a helical heat exchanger channel within the silicon carbide member and in fluid communication with the compressed air inlet; and a plurality of hot air channels extending from the silicon carbide member top side to the silicon carbide member bottom side; a combustion chamber engaged with the silicon carbide member bottom side comprising: an air inlet with a fan for receiving air; a gas conduit for receiving a fuel; and an ignition source for igniting the fuel and the air within the combustion chamber, forming a hot gas, wherein the combustion chamber is in fluid communication with the plurality of hot air channels to transfer heat from the combustion chamber to compressed air within the helical heat exchanger channel, forming a hot pressurized air; and an exhaust chamber engaged on the silicon carbide member top side and in fluid communication with the plurality of hot air channels for exhausting the hot gas from the heat exchanger; and a hot pressurized air outlet disposed through the protective shell and in fluid communication with the helical heat exchanger channel; and c. a nozzle assembly in fluid communication with the metal particulate source and the hot pressurized air source, wherein the nozzle assembly is configured to receive the hot pressurized air to form a venturi effect within the nozzle assembly, wherein the venturi effect draws the metal particulate into the nozzle assembly forming an air metal mixture, and wherein the nozzle assembly comprises:

(i) a nozzle cap comprising a nozzle cap top side and a nozzle cap bottom side;

(ii) a tapered nozzle connected to the nozzle cap bottom side comprising: a wide end tapering to a nozzle tip and an outer surface; and a helical channel formed in a portion of the outer surface adjacent the wide end and extending toward the nozzle tip;

(iii) an outer tip comprising a first tip end and a second tip end, wherein the first tip end is connected to the nozzle cap bottom side, and wherein the outer tip comprises:

1. a venturi effect chamber at the first tip end comprising: a chamber wall and a first rifling extending around the chamber wall, wherein the tapered nozzle is disposed within the venturi effect chamber; and
2. a mixing conduit in fluid communication with the venturi effect chamber comprising: an interior wall, a second rifling extending around the interior wall, and a nozzle orifice at the second tip end;

(iv) a particulate channel in the nozzle cap comprising: a first opening at the nozzle cap top side and a second opening at the nozzle cap bottom side proximate the helical channel, wherein the particulate channel is in fluid communication with the metal particulate source; and (v) a tapered channel extending from the nozzle cap top side to the nozzle tip, wherein the tapered channel has a constant diameter extending from the nozzle cap top side to the nozzle cap bottom side, wherein the tapered channel has a tapered diameter extending from the nozzle cap bottom side to the nozzle tip, wherein the tapered channel has a hot air conduit for receiving the hot pressurized air, and wherein:

1. the tapered channel is in fluid communication with the venturi effect chamber and wherein the hot pressurized air is expelled at the nozzle tip, forming the venturi effect that draws the metal particulate into the particulate channel;
2. the helical channel is configured to form a first vortex flow as the metal particulate flows from the particulate channel into the venturi effect chamber;
3. the mixing conduit is configured to form a second vortex flow of the air metal mixture; and
4. the nozzle orifice is configured to expel the air metal mixture onto the object to form a coating, layer, or deposit thereon.

2. The system of claim 1, wherein the wide end has a wide end diameter that is greater than a tapered nozzle diameter of the nozzle tip.

3. The system of claim 1, further comprising:

a. a conduit at least partially disposed within the particulate channel and in fluid communication with the metal particulate source for controlled introduction of the metal particulate into to the venturi effect chamber; and b. the hot air conduit is at least partially disposed within the tapered channel and in fluid communication with the hot air source for controlled introduction of the hot pressurized air into the venturi effect chamber, wherein the conduit and the hot air conduit are both flexible and configured to allow a user to orient and adjust a direction of the nozzle orifice for controlled expulsion of the air metal mixture onto the object.

4. The system of claim 1, further comprising a filter in fluid communication between the exhaust chamber and the metal particulate source, wherein the filter is for:

a. receiving the hot gas from the exhaust chamber;

b. removing sparks, other hot objects, or combinations thereof from the hot gas; and c. transmitting the hot gas to the metal particulate source to preheat the metal particulate prior to drawing the metal particulate into the nozzle assembly.

5. The system of claim 1, wherein the fuel is natural gas, gasoline, propane, diesel fuel, acetylene, hydrogen gas, or another flammable substance, and wherein the ignition source is an electrical arc.

6. The system of claim 1, further comprising a metal tubing in the helical heat exchanger channel.

7. The system of claim 1, wherein the tapered channel is threadably engaged with the hot air conduit.

8. The system of claim 1, further comprising:

a. a first temperature sensor embedded within the silicon carbide member, a second temperature sensor in the hot air conduit adjacent the hot pressurized air outlet, a third temperature sensor in the hot air conduit adjacent the tapered channel, or combinations thereof;

b. a microcontroller on the protective shell and in communication with the first temperature sensor, the second temperature sensor, the third temperature sensor, or combinations thereof for receiving sensed temperatures therefrom; and c. a data storage in communication with the microcontroller, wherein the data storage comprises:

(i) a preset maximum temperature;

(ii) a preset minimum temperature;

(iii) an optimum operational temperature;

(iv) computer instructions to receive and store the sensed temperatures;

(v) computer instructions to compare at least one of the sensed temperatures to: the preset maximum temperature, the preset minimum temperature, the optimum operational temperature, or combinations thereof;

(vi) computer instructions to initiate an alarm when any of the sensed temperatures exceeds the preset maximum temperature or falls below the preset minimum temperature; and (vii) computer instructions to shut down the hot pressurized air source when any of the sensed temperatures exceeds the preset maximum temperature or falls below the preset minimum temperature.

9. The system of claim 8, wherein:

a. the optimum operational temperature is an optimum temperature for the hot pressurized air during application of the metal particulate onto the object;

b. the preset maximum temperature is a maximum temperature for the hot pressurized air during application of the metal particulate onto the object; and c. the preset minimum temperature is a minimum temperature for the hot pressurized air during application of the metal particulate onto the object.

10. The system of claim 8, wherein the microcontroller is in communication with a client device through a network for remote monitoring and management.

11. The system of claim 8, further comprising:

a. a first safety shut off valve on the air inlet, wherein the first safety shut off valve is a one-way valve mechanically configured to prevent flow of the air from the combustion chamber;

b. a second safety shut off valve on the exhaust chamber, wherein the second safety shut off valve is a one-way valve mechanically configured to prevent flow of the air into the exhaust chamber from outside of the protective shell;

c. a third safety shut off valve on the metal particulate source for allowing the hot gas to flow into the metal particulate source to preheat the metal particulate, wherein the third safety shut off valve is in fluid communication with the exhaust chamber; and d. a fourth safety shut off valve on the metal particulate source for allowing the metal particulate to flow to the nozzle assembly, wherein the fourth safety shut off valve is a one way valve mechanically configured to prevent flow into the metal particulate source, and wherein the computer instructions to shut down the hot pressurized air source are configured to close at least one of the safety shut off valves and to shut down power to the fan.

12. The system of claim 1, further comprising:

a. a distance sensor disposed on the outer tip configured to measure a distance between the outer tip and the object; and b. an indicator in communication with the distance sensor for indicating when the outer tip is and is not at a predetermined distance from the object.

13. The system of claim 12, wherein:

a. the distance sensor is an optical sensor, a laser range finder, or another distance indicator; and b. the predetermined distance is a distance configured to ensure an optimal speed and temperature of the air metal mixture upon impact with the object.

14. The system of claim 1, wherein the object is selected from the group consisting of: a bridge, a barge, a ship, an oil rig, a coker unit, a vapor recovery unit, a terrestrial pipeline, an underwater pipeline, a frac tank, and a boat trailer.

15. The system of claim 1, wherein the metal particulate is selected from the group consisting of: aluminum particulate, copper particulate, titanium particulate, platinum particulate, copper alloy particulate, and aluminum alloy particulate.

16. The system of claim 1, wherein the nozzle assembly is made of fused silica, ceramic, stainless steel, cobalt, titanium, or chromium.

17. The system of claim 1, wherein the hot pressurized air is at a pressure of at least 100 psi and at a temperature of at least 1500 degrees Fahrenheit.

18. A system for applying a metal particulate onto an object, the system comprising:

a. a metal particulate source for providing the metal particulate:

b. a hot pressurized air source for providing a hot pressurized air; and c. a nozzle assembly in fluid communication with the metal particulate source and the hot pressurized air source, wherein the nozzle assembly is configured to receive the hot pressurized air to form a venturi effect within the nozzle assembly, wherein the venturi effect draws the metal particulate into the nozzle assembly forming an air metal mixture, and wherein the nozzle assembly comprises:

(i) a nozzle cap comprising a nozzle cap top side and a nozzle cap bottom side;

(ii) a tapered nozzle connected to the nozzle cap bottom side comprising: a wide end tapering to a nozzle tip and an outer surface; and a helical channel formed in a portion of the outer surface adjacent the wide end and extending toward the nozzle tip;

(iii) an outer tip comprising a first tip end and a second tip end, wherein the first tip end is connected to the nozzle cap bottom side, and wherein the outer tip comprises:

1. a venturi effect chamber at the first tip end comprising: a chamber wall and a first rifling extending around the chamber wall, wherein the tapered nozzle is disposed within the venturi effect chamber; and 2. a mixing conduit in fluid communication with the venturi effect chamber comprising: an interior wall, a second rifling extending around the interior wall, and a nozzle orifice at the second tip end;

(iv) a particulate channel in the nozzle cap comprising: a first opening at the nozzle cap top side and a second opening at the nozzle cap bottom side proximate the helical channel, wherein the particulate channel is in fluid communication with the metal particulate source; and (v) a tapered channel extending from the nozzle cap top side to the nozzle tip, wherein the tapered channel has a constant diameter extending from the nozzle cap top side to the nozzle cap bottom side, wherein the tapered channel has a tapered diameter extending from the nozzle cap bottom side to the nozzle tip, wherein tapered channel is parallel and adjacent to the particulate channel, and wherein:

1. the tapered channel is in fluid communication with the venturi effect chamber and the hot pressurized air source for receiving the hot pressurized air and expelling the hot pressurized air at the nozzle tip, forming the venturi effect that draws the metal particulate into the particulate channel;

2. the helical channel is configured to form a first vortex flow as the metal particulate flows from the particulate channel into the venturi effect chamber;

3. the mixing conduit is configured to form a second vortex flow of the air metal mixture; and 4. the nozzle orifice is configured to expel the air metal mixture onto the object to form a coating, layer, or deposit thereon.

* * * * *